US009540834B2

(12) United States Patent
Spicer et al.

(10) Patent No.: US 9,540,834 B2
(45) Date of Patent: Jan. 10, 2017

(54) COVER ASSEMBLY FOR A SPA

(71) Applicant: Strong Industries, Inc., Northumberland, PA (US)

(72) Inventors: Wade Spicer, Northumberland, PA (US); Ryan Force, Nescopeck, PA (US)

(73) Assignee: STRONG INDUSTRIES, INC., Northumberland, PA (US)

( * ) Notice: Subject to any disclaimer, the term of this patent is extended or adjusted under 35 U.S.C. 154(b) by 95 days.

(21) Appl. No.: 14/457,631

(22) Filed: Aug. 12, 2014

(65) Prior Publication Data

US 2015/0204094 A1 Jul. 23, 2015

Related U.S. Application Data

(63) Continuation-in-part of application No. 14/159,710, filed on Jan. 21, 2014.

(60) Provisional application No. 61/931,913, filed on Jan. 27, 2014.

(51) Int. Cl.
*E04H 4/08* (2006.01)

(52) U.S. Cl.
CPC ..... *E04H 4/084* (2013.01); *Y10T 29/49817* (2015.01)

(58) Field of Classification Search
CPC ..... E04H 4/084; Y10S 292/11; E05C 19/00; E05C 19/03; E05C 19/005; E05B 65/0888; B65D 43/163; B65D 43/161; B65D 43/16; B65D 43/20; B65D 45/16; B65D 45/18; B65D 45/20; B65D 45/22; B65F 1/1615; B65F 1/15; B65F 2001/1669
USPC ..... 4/498–503; 292/259 R
See application file for complete search history.

(56) References Cited

U.S. PATENT DOCUMENTS 109,330 A * 11/1870 Maddox ..... B63B 19/24 114/203
323,980 A * 8/1885 Van Allen ..... E05C 17/50 217/56
4,998,425 A * 3/1991 Hoogland ..... B60R 9/00 224/315
D367,709 S * 3/1996 Lawing ..... D24/201
D384,479 S * 9/1997 Ouelette ..... D34/28
5,685,031 A * 11/1997 Watkins ..... E04H 4/08 4/498
5,950,252 A * 9/1999 Fettes ..... E04H 4/084 4/498
5,974,600 A * 11/1999 Pucci ..... E04H 4/084 4/498
6,381,766 B1 * 5/2002 Perry ..... E04H 4/084 16/239
6,722,709 B2 * 4/2004 Bergdoll ..... B65F 1/1615 292/1

(Continued)

*Primary Examiner* — Erin Deery
(74) *Attorney, Agent, or Firm* — Grogan, Tuccillo & Vanderleeden, LLP

(57) ABSTRACT

A cover assembly for a spa having a base and a shell supported by the base is provided. A cover assembly includes a cover member selectively movable between a covered position and an uncovered position, and a lifting assembly configured to effect movement of said cover member between the covered position and the uncovered position. The lifting assembly includes a first lifting arm and a second lifting arm. The first lifting arm is pivotally and slidably coupled to the base at a first end thereof and pivotally coupled to the cover member and to the second lifting arm at a second end thereof.

17 Claims, 11 Drawing Sheets

(56) References Cited

U.S. PATENT DOCUMENTS

| | | | | |
|---|---|---|---|---|
| 6,795,984 | B1 * | 9/2004 | Brady | E04H 4/084 220/263 |
| 6,859,952 | B2 * | 3/2005 | Perry | E04H 4/084 4/498 |
| 7,389,551 | B2 * | 6/2008 | Stebner | E04H 4/08 24/302 |
| 8,726,429 | B1 * | 5/2014 | Midkiff | E04H 4/084 4/498 |
| 9,080,340 | B2 * | 7/2015 | Timischl | E04H 4/084 |

* cited by examiner

COVER ASSEMBLY FOR A SPA

CROSS-REFERENCE TO RELATED APPLICATIONS

The present application is a continuation-in-part of U.S. patent application Ser. No. 14/159,710, filed on Jan. 21, 2014, and further claims the benefit of U.S. Provisional Patent Application Ser. No. 61/931,913, filed on Jan. 27, 2014, each of which is herein incorporated by reference in its entirety.

FIELD OF THE INVENTION

The present invention relates generally to spas and, more particularly, to a cover assembly for a spa.

BACKGROUND OF THE INVENTION

Spas, also commonly known as hot tubs, are popular fixtures that are used in many homes. They generally include a deep, vacuum formed tub having a smooth acrylic liner that is filled with heated water and which is used for soaking and relaxation. Spas typically include water jets for massage purposes.

Typically, the acrylic liner is formed into shapes that provide a variety of seating arrangements within the tub. Each seat is usually equipped with hydrotherapy jets that allow a pressurized flow of water to be directed at various parts of a user's body. The water flow may be aerated for additional effect, and some or all of the jets may also automatically move or rotate, causing the changing pressure of the water on the body to provide a massage-like effect.

Because many spas/hot tubs are located outdoors, they are often equipped with covers for enclosing the tub when not in use. These covers help prevent dirt, leaves and other debris from entering the water, and provide a safety function by preventing small children and animals from falling into the water. Moreover, spa covers are often insulated so as to limit heat loss from the water when the spa is not in use for purposes of energy efficiency and readiness of use.

As will be readily appreciated, however, existing covers for spas are heavy and cumbersome, making them difficult for a user to remove prior to using the spa and to place back over the spa when it is no longer in use. In addition, existing covers and the mechanisms for removing the covers can be prone to breakage.

In view of the above, there remains a need for a cover assembly for a spa that is easier to remove and replace, and which is less prone to breakage.

SUMMARY OF THE INVENTION

It is an object of the present invention to provide a cover assembly for a spa.

It is another object of the present invention to provide a cover assembly for a spa that is easier to remove and replace than existing covers.

It is another object of the present invention to provide a cover assembly for a spa that is more durable than existing covers.

It is another object of the present invention to provide a cover assembly for a spa that is ergonomic.

It is another object of the present invention to provide a cover assembly for a spa that minimizes the buildup of rainwater, snow and debris.

It is yet another object of the present invention to provide a cover assembly that is capable of being retrofit onto existing spas.

According to an embodiment of the present invention, a cover assembly for a spa having a base and a shell supported by the base is provided. The cover assembly includes a cover member selectively movable between a covered position and an uncovered position, and a lifting assembly configured to effect movement of said cover member between the covered position and the uncovered position. The lifting assembly includes a first lifting arm and a second lifting arm. The first lifting arm is pivotally and slidably coupled to the base at a first end thereof and pivotally coupled to the cover member and to the second lifting arm at a second end thereof.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Referring to FIGS. 1-8, a spa 200 having a cover assembly 210 according to an embodiment of the present invention is shown. The spa 200 may be of any type known in the art and includes a base defining a spa cabinet 212, and an acrylic shell 214 supported by the base. In particular, the spa cabinet 212 serves as the support structure of the spa and may be of any type known in the art, such as framed or sub-frameless.

For example, the cabinet 212 may be a sub-frameless spa and may include a pair of end member, a pair of side members, and a base member. While the spa shell 214 is preferably formed from acrylic, it may be formed of any suitable plastic material or other impermeable material suitable for holding water.

Figure 1:
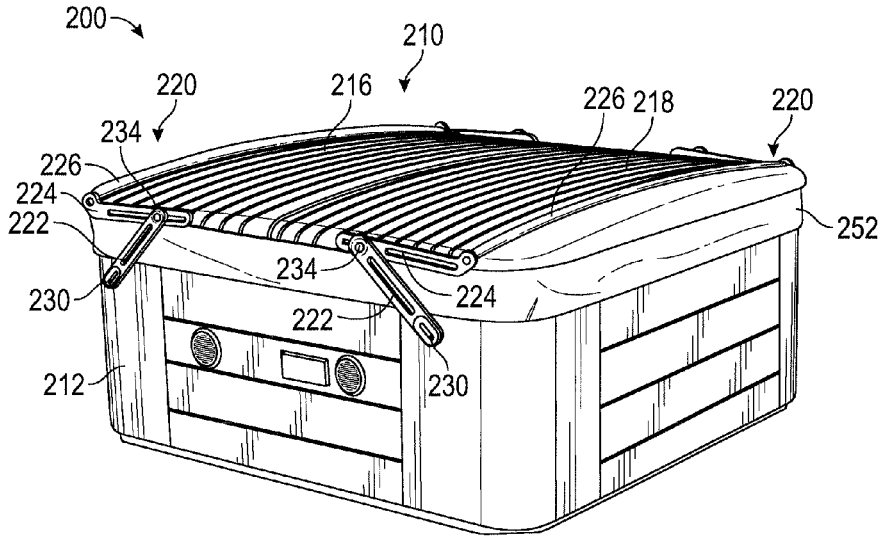
FIG. 1 is a perspective view of a spa having a cover assembly in accordance with an embodiment of the present invention, illustrating the cover assembly in a covered position.
Figure 2:
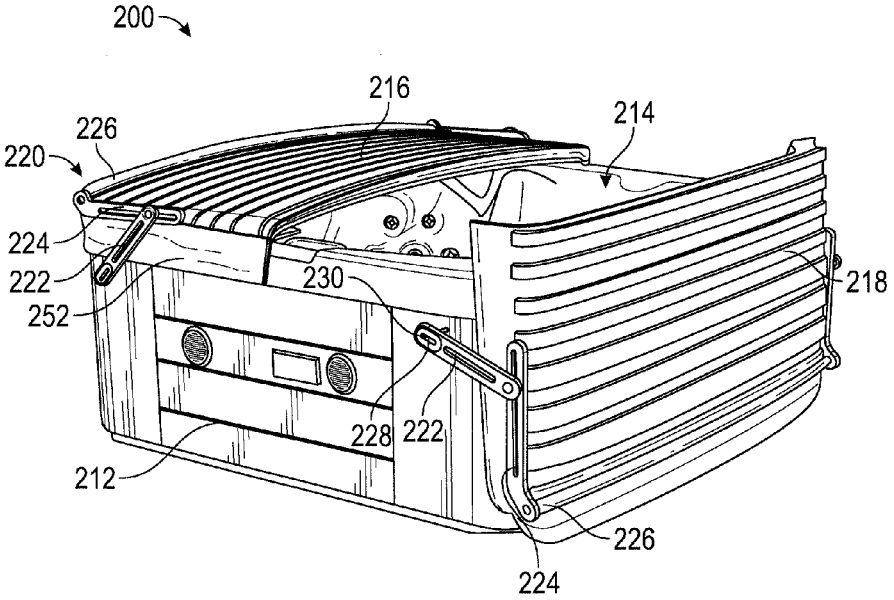
FIG. 2 is a perspective view of the spa of FIG. 1, illustrating half of the cover assembly in a covered position and the over half in an uncovered position.
Figure 3:
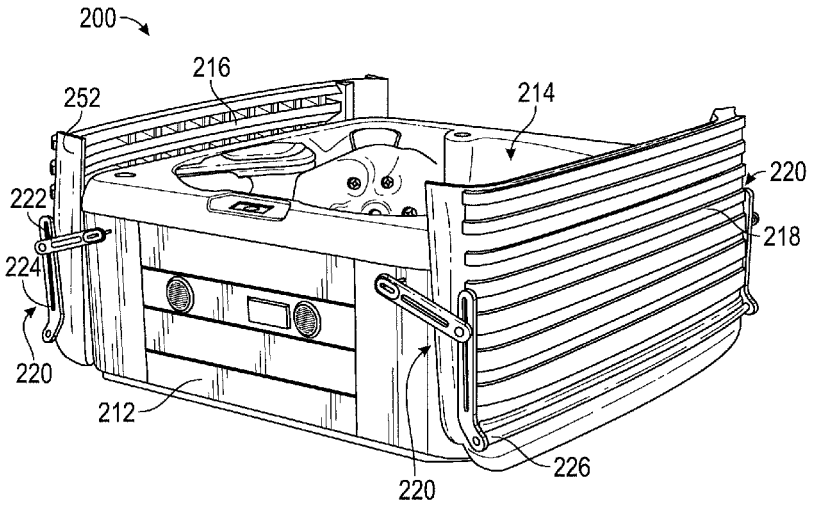
FIG. 3 is a perspective view of the spa of FIG. 1, illustrating the cover assembly in a fully uncovered position.
Figure 4:
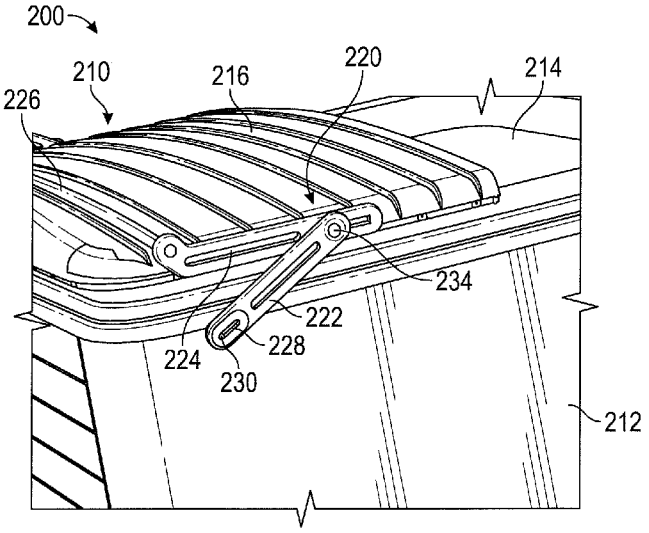
FIG. 4 is an enlarged, perspective view of the cover assembly of the spa of FIG. 1.
Figure 5:
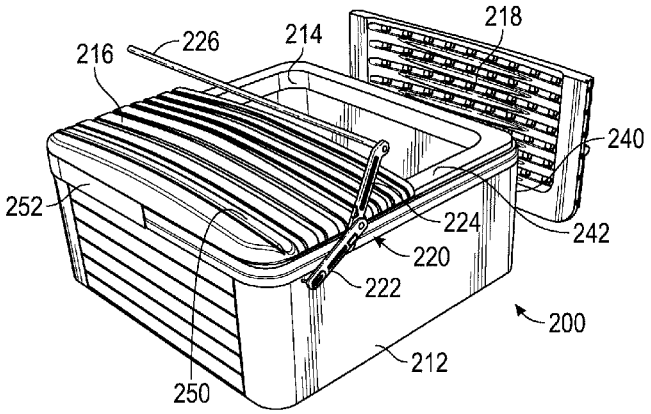
FIG. 5 is a partially exploded, perspective view of the spa and cover assembly of FIG. 1.

As best shown in FIGS. 1-5, the cover assembly 210 according to the present invention includes first and second cover members 216, 218 that are configured to selectively cover first and second halves, respectively, of the top of the spa 200. In an embodiment, each cover member 216, 218 may include a top half and a bottom half that are joined together through stand-offs. The cover assembly 210 also includes a lifting mechanism 220 associated with each cover member 216, 218 that allows a user to selectively move the cover members 216, 218 between a covered position, as shown in FIG. 1, to an uncovered position, as best shown in FIG. 3.

Each lifting mechanism 220 includes first lifting arms 222 arranged on opposing sides of the spa, second lifting arms 224 also arranged on opposing sides of the spa 200 and pivotally and slidably coupled to the first lifting arms 222, and a handle 226 connected to distal ends of the second lifting arms 224. The handle 226 is slightly arcuate in shape and, preferably, mirrors the curvature of the upper surface of the cover members 216, 218.

Figure 6:
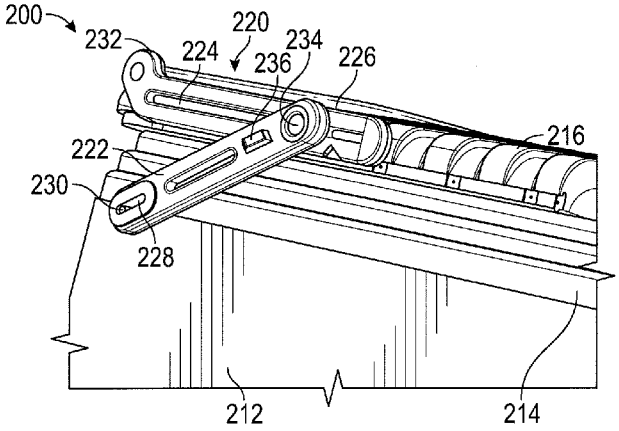
FIG. 6 is an enlarged, perspective view of the spa and cover assembly of FIG. 1, illustrating a lifting mechanism of the cover assembly.
Figure 7:
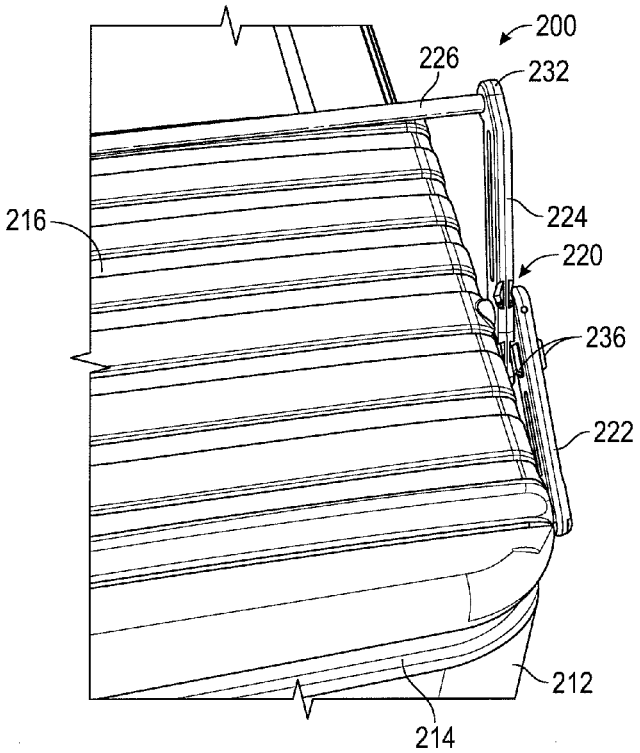
FIG. 7 is an enlarged, perspective top view of the spa and cover assembly of FIG. 1, illustrating the lifting mechanism.
Figure 8:
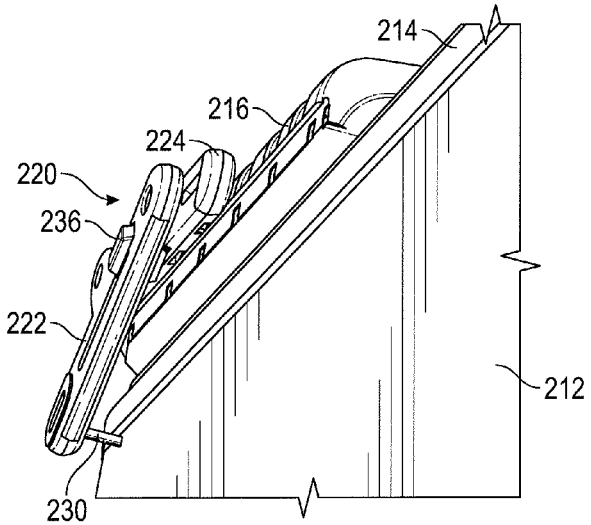
FIG. 8 is an enlarged, perspective side view of the spa and cover assembly of FIG. 1, illustrating the lifting mechanism.
Figure 9:
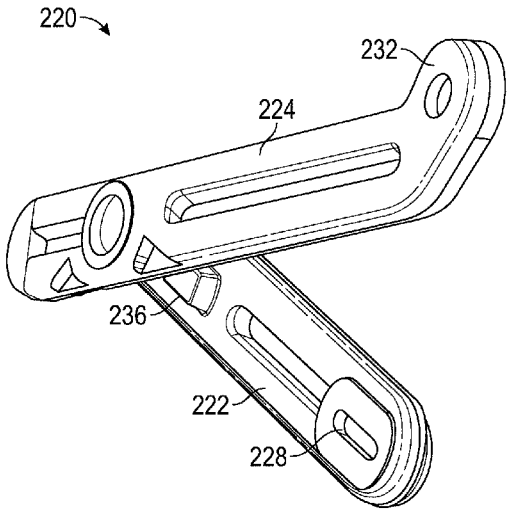
FIG. 9 is a perspective view of the lifting mechanism of the cover assembly.

As best shown in FIGS. 6, 9 and 37 the first lifting arm 222 is a generally flat plate that includes a longitudinal slot 228 formed in one end thereof and is rotatably and slidably coupled to the spa cabinet 212 by a first pin 230. Importantly, as discussed in detail below, the first lifting arm 222 translates along and rotates about the pin 230. As also shown therein, the second lifting arm 224 is similarly shaped, but is longer than the first lifting arm 222 and includes a small, upwardly depending leg 232 that serves to locate the handle 226 above the top surface of the cover members 216, 218.

As further shown in FIGS. 1-6, the first lifting arm 222 is also pivotally connected to the second lifting arm 224 at a distal end of the first lifting arm 222, and both lifting arms 222, 224 are pivotally connected to the cover member 216, 218 via a second pin 234. In an embodiment, the second pin 234 extends from one side of the cover member 216, 218 to the other, connecting the opposed lifting mechanisms 220 to one another such that the opposed lifting arms share the same axis of rotation. In the preferred embodiment, the pin 234 is a metal rod housed within a plastic pipe, such as PVC. The provision of a plastic wrapping or pipe surrounding the metal rod seals the opening to the cover members 216, 218 where the pin 234 passes through and prevents wear from continued use. As will be readily appreciated, the provision of a unitary pin 234 that extends the width of the cover member 216, 218 also adds structural rigidity to the lifting mechanisms 220 and to the cover assembly 210, as a whole.

Importantly, the lifting mechanisms 220 allow the cover members 216, 218 to slide horizontally atop the shell 214 relative to the first pin 230, as well as to rotate about the first pin 230 relative to the spa cabinet 212. In addition, the cover members 216, 218 are able to rotate or pivot about an axis defined by the second pin 234. In this respect, the cover members 216, 218 each have two points of rotation, which facilitates easy and smooth operation, as discussed hereinafter.

As also shown in FIGS. 6-9 the lifting arms 222, 224 are configured with a plurality of position stops that serve to limit the movement of the lifting arms 222, 224 with respect one another. In particular, the first lifting arm 222 includes outer and inner position stops 236 on opposed sides thereof that are configured to limit upwards rotation of the second lifting arm 224. In particular, as the handle 226 is lifted from atop the cover to cause the second lifting arm 224 to be rotated about pin 234, the second lifting arm 224 will eventually contact the inner position stop 236, thereby arresting further rotation thereof.

Figure 10:
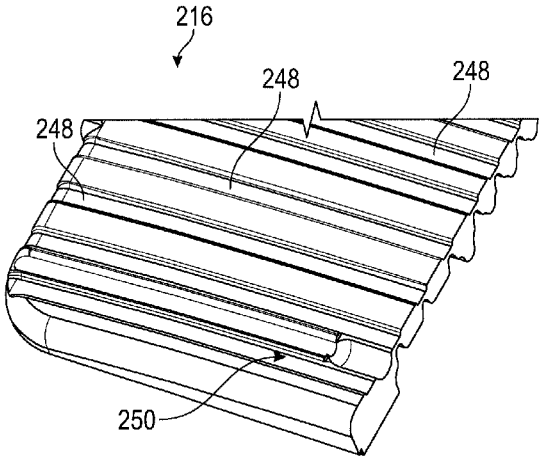
FIG. 10 is a perspective view showing the top side of a cover member of the cover assembly.
Figure 11:
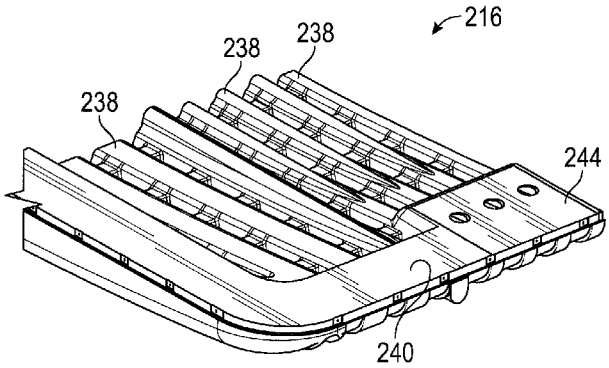
FIG. 11 is perspective view showing the underside of a cover member of the cover assembly.
Figure 12:
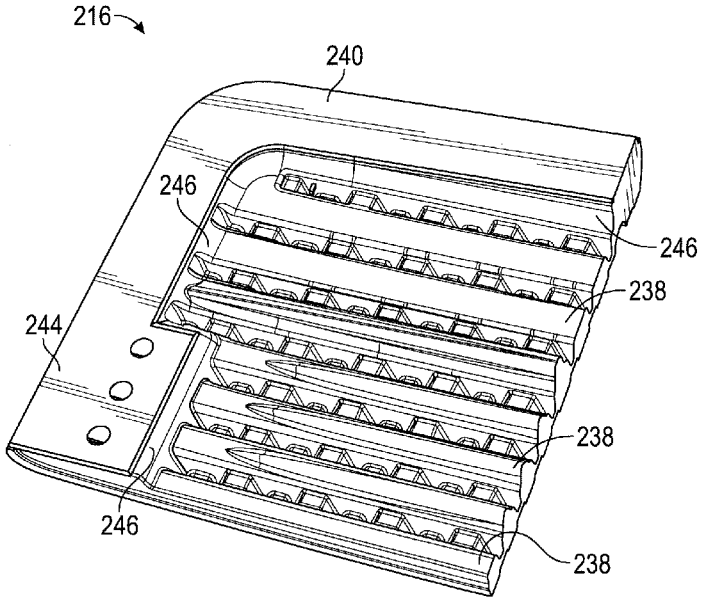
FIG. 12 is another perspective view showing the underside of a cover member of the cover assembly.

With reference to FIGS. 10-12, the cover members 216, 218 are double-walled and are preferably formed from blow molded or rotational molded plastic and may contain insulating materials to slow the loss of heat from water held within the shell 214. Importantly, the cover members 216, 218 are substantially rigid and are not generally susceptible to bending or flexing during normal use. As shown therein, the cover members 216, 218 preferably include a plurality of reinforcing ribs 238 that span the width of the cover members 216, 218. These ribs 238 add structural rigidity to the cover members 216, 218 and prevent the cover members 216, 218 from caving in due to snow load, small animals or other debris that may fall onto the spa 200. The cover members 216, 218 may, therefore, take a generally corrugated-like configuration, thereby increasing the structural integrity of the cover members 216, 218 such that the cover can support substantial load without buckling.

The cover members 216, 218 also have a peripheral flange 240 on the underside thereof, as best shown in FIGS. 11 and 12. The peripheral flange 240 is configured to mate with a corresponding flat surface 242 on the shell 214 of the spa 200 to form a seal. This seal between the cover members 216, 218 and the shell 214 of the spa 200 functions to minimize the loss of heat from the water held within the shell 214 when the cover members 216, 218 are in the covered position. In the preferred embodiment, the peripheral flange 240 is formed from a gasket material such as rubber or other resilient sealing material known in the art. In an embodiment, the peripheral flange 240 may include a portion 244 with an increased surface area, as well as a resilient gasket 246 that protrudes from the peripheral flange 240 on the inner portion thereof. By providing a relatively wide flange 240 for contacting the upper surface of the shell 214, the cover assembly 210 can be sold and utilized as an aftermarket product that can be easily retrofit onto existing spas. This gasket material may also be provided on a lateral sidewall cover members 216, 218 where the cover members 216, 218 contact each other when in the closed position. As will be readily appreciated, this minimizes the loss of heat through the seam where the cover members 216, 218 meet.

In addition, the cover members 216, 218 also include a plurality of channels 248 formed in a top surface thereof, as shown in FIG. 10. These channels 248, along with the convex outer curvature of the cover members 216, 218, function to drain rainwater from the top of the cover members 216, 218. Accordingly, the particular configuration of the cover assembly 210 of the present invention is more structurally sound than existing designs, thereby eliminating the potential for damage or breakage. The provision of these channels 248 also provides a recess 250 in which the handle 226 can nest when not in use, thereby increasing aesthetics.

As the cover members 216, 218 are formed from hard plastic and are sealed, water from rain or from the interior of the spa 200 is prevented from entering the interior of the cover members 216, 218. As will be readily appreciated, this prevents the insulating material within the cover members 216, 218 from absorbing water. This is in stark contrast to existing vinyl-wrapped foam spa covers which are susceptible to water absorption over time, which greatly increases the weight of such covers, rendering them difficult to use.

With further reference to FIGS. 1-3, the cover members 216, 218 may each be outfitted with a peripheral skirt 252 that extends from the outer edges of the cover members 216, 218 over a portion of the sidewalls of the cabinet 212. In the preferred embodiment, this skirt 252 is vinyl and functions to further inhibit heat loss.

Figure 13:
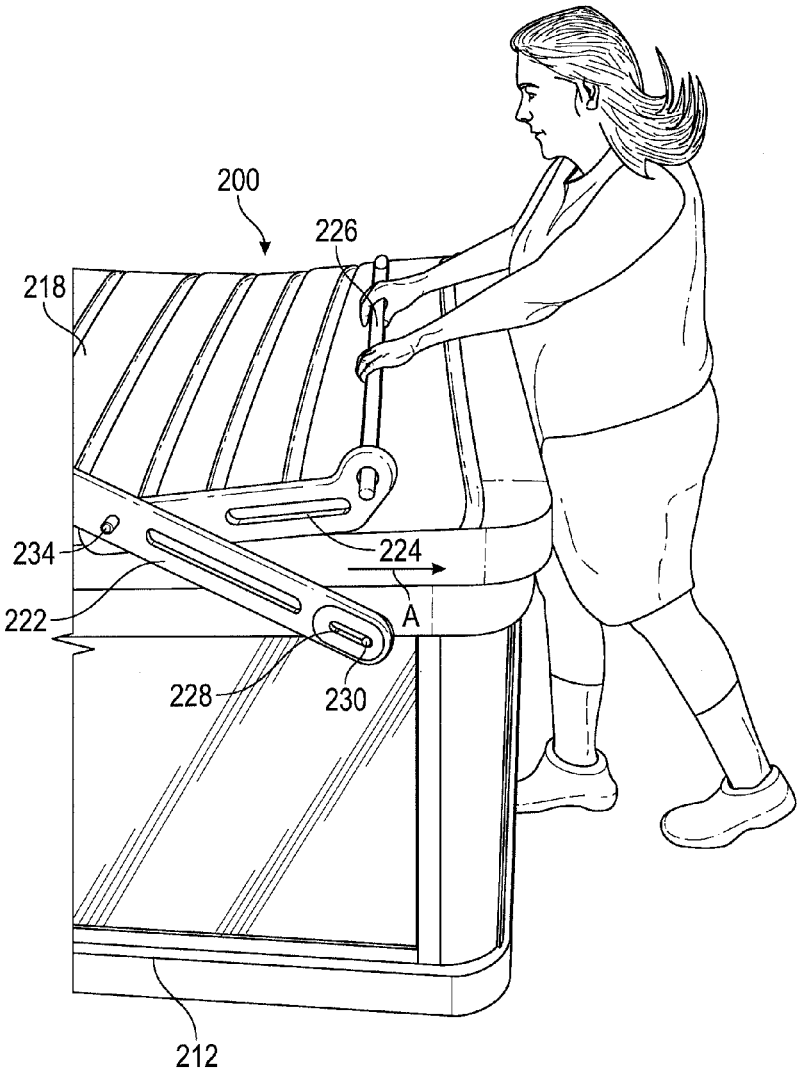
FIGS. 13-15 illustrate an uncovering operation of the cover assembly.
Figure 14:
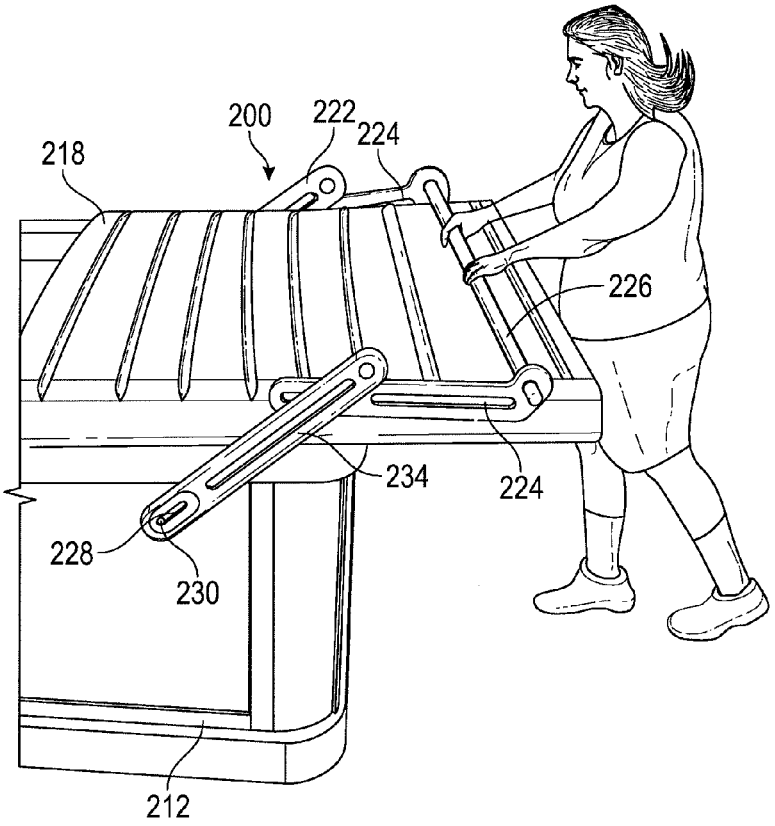
Figure 15:
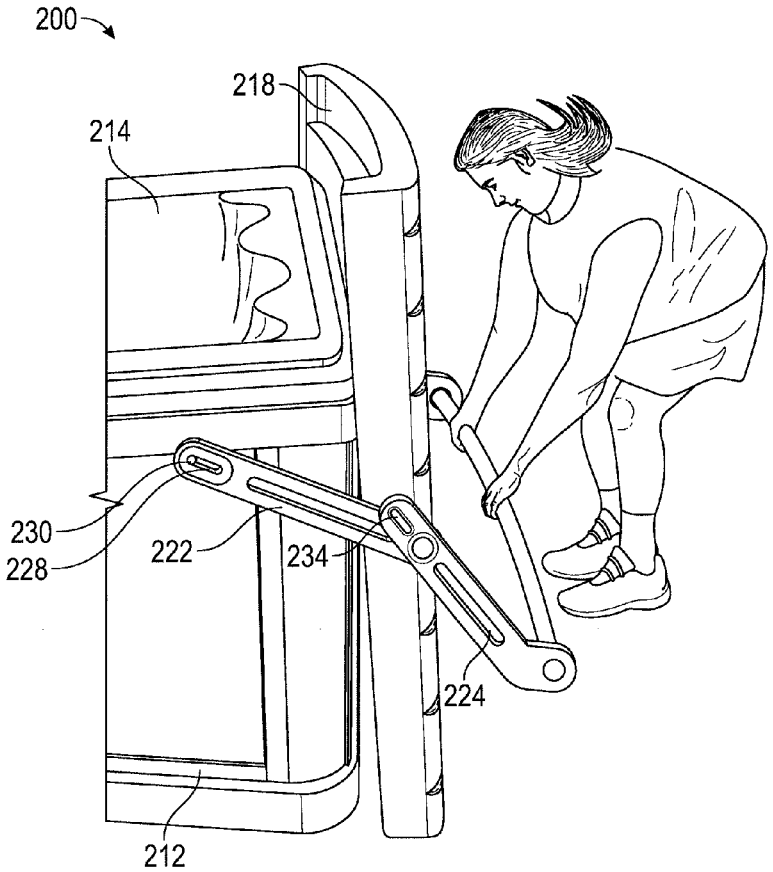
Figure 16:
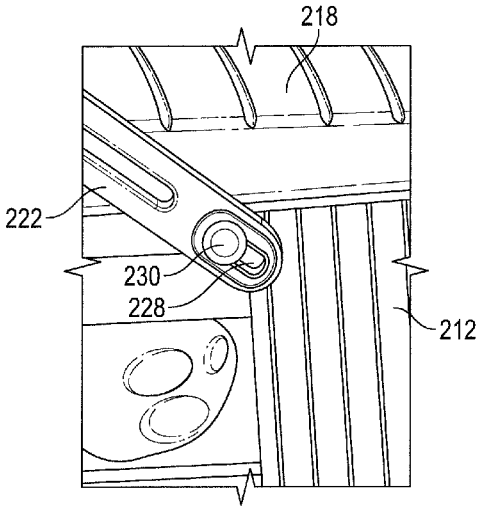
FIG. 16 is an enlarged, detail view of a pin and slot connection of the lifting mechanism.

With reference to FIGS. 13-15, an uncovering operation is illustrated. In use, to uncover the spa 200, a user grasps handle 226 which is accessible from the side of the spa and pulls towards the side of the spa 200, in the direction of arrow A as shown in FIG. 13. Pulling force on the handle 226 is transmitted to the cover member 218 by way of interaction of the second pin 234 with the cover member 218. Because of the slot 228, the cover member 218 is allowed to slide horizontally atop the shell 214, guided by the first pin 230 within the slot 228. As the cover member 218 slides horizontally atop the shell 214, the first lifting arm 222 begins to rotate vertically. At this point, with the first lifting arm 122 forming a substantially 90 degree angle with the second lifting arm 224, the first pin 230 contacts the opposite end of the slot 228, closest to the second pivot point 234. Continued pulling force on the handle 226 causes the cover member 216 to further slide horizontally atop the shell 214 even as the first lifting arm 222 rotates past 90 degrees, as shown in FIG. 14.

As the second pivot point 234 moves past the edge of the spa cabinet 212, the cover member 218 rotates downward about the second pivot point 234, while the first lifting arm 222 translates and rotates about the first pivot point 230. That is, the cover member 218 moves only laterally until the second pivot point passes the edge of the spa cabinet 212. As will be readily appreciated, by means of the slot 228 and pin 230 configuration, the cover member 218 continues to move both horizontally and downward as a pulling force is exerted on the handle 226. With specific reference to FIG. 14 the cover member 218 continues to move horizontally until the distal end of the slot 228 contacts the first pivot pin 228. From this point, the cover member rotates relative to the first pin 228 and second pin 234 as it drops to the side of the spa 200.

As gravity takes over and pulls the cover member 218 downward to the side of the spa, a user continues to hold the handle 226 to prevent the cover member 218 from dropping forcefully to the ground. Holding the handle 226 as the cover member 218 drops to the side of the spa 200 causes the second lifting arms 224 to rotate upwardly about second pin 234. Further upward rotation of the second lifting arms 224, however, is arrested by the position stops 236. In particular, the second lifting arms 224 contact the position stops that protrude laterally from the first lifting arms 222, thereby preventing further rotation of the second lifting arms 224. A user may then guide the cover member 218 to its fully uncovered position adjacent to the side of the spa 200, as illustrated in FIG. 15. Importantly, the lifting mechanisms 220 provide a lever action, allowing a user to easily and smoothly remove the cover members 216 without much effort.

As will be readily appreciated, to cover the spa 200, the steps described above are performed in reverse. In particular, to cover the spa 200, a user grasps lifter handle 226 and pulls upwards, causing second pivot pin 234 to exert an upward force on the cover member 218, thereby causing the cover member 218 to move upward as the first lifting arm 222 rotates about the first pin 230. As a user continues lifting up on the handle 226, the cover member 218 begins to rotate about pin 234 towards a horizontal position as the second pivot pin 234 passes the top edge of the spa 200. Further upwards force on the handle 226 causes the first lifting arm 222 to translate along the first pivot pin 230 until the cover member 218 comes to rest atop the shell 214. When the first lifting arm 222 is in a substantially vertical position, and forms a substantially 90 degree angle with the second lifting arm 224, the cover member 218 is substantially horizontal and partially covers the spa 200. In this position, the first pivot pin 230 is received in the slot 228 at the end closest to the second pivot pin 234. A user may then exert a pushing force on the handle 226 so that the first lifting arm 222 translates along pin 230 in the opposite direction, to slide the cover member 218 horizontally along the shell 214, in the direction of arrow B, to its fully covered position.

As indicated above, the cross-arm design, the two rotational axes and the slot and pin connection of the lifting assembly 220 permits covering and uncovering without much effort. Ease of covering and uncovering is further increased by the two-piece cover assembly design (i.e., two cover members 216, 218 that mate in the middle), which decreases the weight that must be lifted. This is in contrast to existing unitary covers which require a user and the lifting mechanism to bear the full weight of the entire cover.

Importantly, this lifting mechanism design, having two axes of rotation, results in a cover assembly 210 that is easy to open or close, to a degree heretofore not seen in the art. By coupling one end of the first lifting arm 222 to the cover member 216, 218 and coupling the second end of the first lifting arm to the spa cabinet 212, the first lifting arm 222 acts as a moment arm which increases the ease by which a user can uncover and cover the spa 200. As a result, this arrangement decreases the amount of force a user must provide to move the cover members 216, 218 between their covered and uncovered positions. As indicated above, this arrangement also provides for automatic leveling of the cover members 216, 218 during closing. It is this lever action that is provided by the intersecting, V-shaped lifting assembly 220 that is an important aspect of the present invention.

In an embodiment, the components of the lifting mechanisms may be manufactured from plastics, although any material known in the art that are of sufficient strength and rigidity to support the weight and rotational movement of the cover members 216, 218, such as metals and the like, may also be utilized without departing from the broader aspects of the present invention.

In an embodiment, the cover assembly 210 of the present invention may be sold and utilized as an aftermarket unit that can be retrofit onto existing spas and hot tubs. In particular, an adjustable bracket, allowing for lateral and vertical adjustment of the location of the pivot point 230, may be utilized to attach the lifting mechanism 220 to the side walls of an existing spa.

In particular, when utilized as an aftermarket cover assembly, cover members 216, 218 are first laid flat and aligned on the top of the existing spa, in covered position such that the upper lip of the shell mates with peripheral flange 240 on the underside of the cover members 216, 218. Once in this position the lifting mechanisms 220 may be mounted to the sides of the spa utilizing an adjustable bracket that allows for lateral and vertical adjustment of the pivot point 230, as indicated above. In particular, the handle 226 is laid flat on the cover members 216, 218, which determines the location of pivot point 230 on the side walls of the spa. The mounting bracket may then be fastened to the side of the spa by any means known in the art, and the first lifting arms 222 connected to the mounting bracket via a ½" hardened bolt or the like that serves as pivot pin 230.

As will be readily appreciated, the ability to quickly and easily retrofit the cover assembly 210 onto existing spas is an important aspect of the present invention. Indeed, it allows owners of existing spas to purchase an aftermarket cover assembly 210 that may be utilized with spas of various designs and configurations, and that is easier to use and is more durable than existing spa covers.

Figure 17:
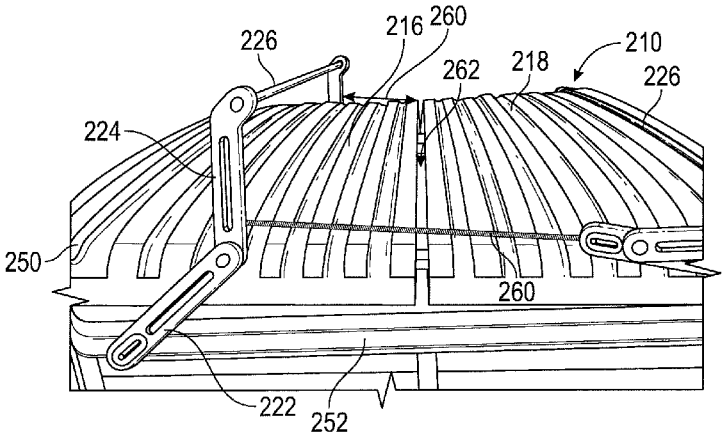
FIGS. 17-19 illustrate a sealing and locking mechanism of the cover assembly according to an embodiment of the present invention.
Figure 18:
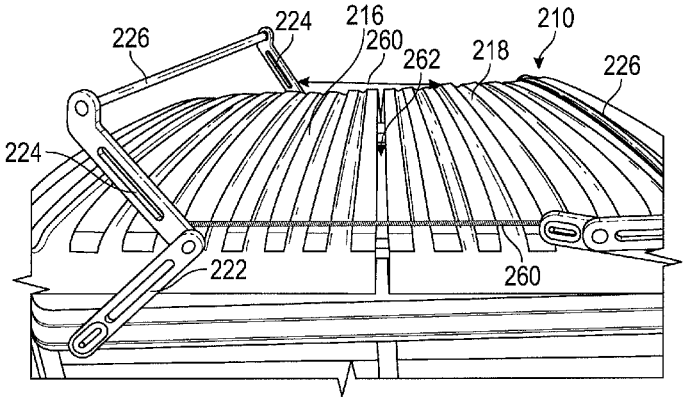
Figure 19:
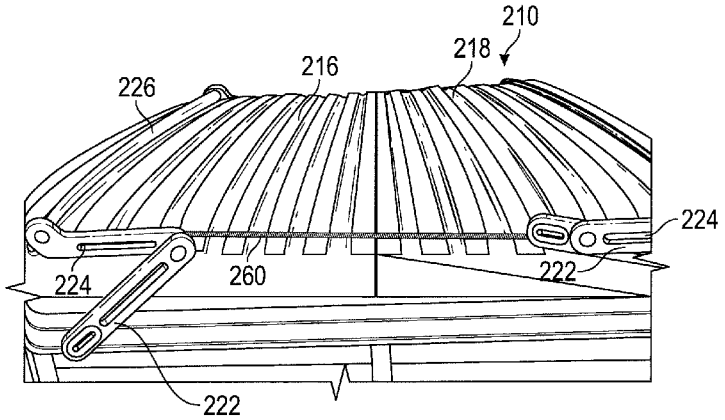

Referring now to FIGS. 17-19, in an embodiment, the cover assembly 210 may include a cam locking and sealing mechanism that functions to create a tight contact and sealing arrangement between the opposed halves 216, 218 of the cover assembly when in the closed position. As shown therein, in an embodiment, the locking and sealing mechanism includes a linkage or tether, such as cable 260, that is connected to opposed second lifting arms 224 on respective sides of the spa 200. As shown in FIG. 17, when the cover members 216, 218 are in their resting positions atop the spa shell and at least one of the handles 226 is in an upright position, there may be a gap 262 between the cover members 216, 218. With reference to FIG. 18, as the handle 226 is urged downwards, a cam action is created which produces a tensile force on the linkage 260 between the opposed lifting arms 224, which draws the two halves 216, 218 of the cover together, closing hap 262. As shown in FIG. 19, when the handle 226 is completely lowered to its seated position, the cam action and the linkage 260 draw the opposed cover members 216, 218 into engagement with one another, fully closing gap 262 and creating a seal and locking arrangement therebetween. As will be readily appreciated, this arrangement further ensures that the incursion of debris or water into the spa 200 is substantially reduced.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A cover assembly for a spa having a base and a shell supported by the base, said cover assembly comprising:

a cover member selectively movable between a covered position and an uncovered position; and a lifting assembly configured to effect movement of said cover member between said covered position and said uncovered position, said lifting assembly including a first lifting arm and a second lifting arm;

wherein said base includes a first pivot pin mounted to said base;

wherein said first lifting arm includes a longitudinal slot in a first end of said first lifting arm, said longitudinal slot being configured to receive said first pivot pin such that said first lifting arm is both pivotally and slidably coupled to said base at said first end of said first lifting arm;

wherein said first lifting arm and said second lifting arm are connected to a second pivot pin extending from said cover member, said second pivot pin providing for pivoting of both said first lifting arm and said second lifting arm relative to said cover member and to one another;

wherein said lifting assembly further includes a handle extending from a distal end of said second lifting arm; and wherein said cover member has a recess formed in an outer surface of said cover member, said recess being sized and shaped to receive said handle therein.

2. The cover assembly of claim 1, wherein:

said lifting assembly provides two axes of rotation for said cover member relative to said base.

3. The cover assembly of claim 2, wherein:

said two axes are vertically and horizontally offset from one another.

4. The cover assembly of claim 1, wherein:

said cover member includes a peripheral flange formed on an underside of said cover member, said flange being configured to matingly contact an upper rim of said shell when said cover member is in said covered position.

5. The cover assembly of claim 1, wherein:

said cover member has a substantially convex outer surface and includes a plurality of channels formed in said outer surface.

6. The cover assembly of claim 1, wherein:

said second pivot pin extends though said cover member;

wherein said first lifting arm is pivotally coupled to a second pivot pin at said second end of said first lifting arm.

7. The cover assembly of claim 1, wherein:

said first lifting arm includes at least one position stop, said position stop being configured to limit rotation of said second lifting arm relative to said first lifting arm.

8. A cover assembly for a spa having a base and a shell supported by the base, said cover assembly comprising:

a cover member selectively movable between a covered position and an uncovered position; and a lifting assembly configured to effect movement of said cover member between said covered position and said uncovered position, said lifting assembly including a first lifting arm and a second lifting arm;

wherein said base includes a first pivot pin mounted to said base;

wherein said first lifting arm includes a longitudinal slot in a first end of said first lifting arm, said longitudinal slot being configured to receive said first pivot pin such that said first lifting arm is both pivotally and slidably coupled to said base at said first end of said first lifting arm;

wherein said first lifting arm and said second lifting arm are connected to a second pivot pin extending from said cover member, said second pivot pin providing for pivoting of both said first lifting arm and said second lifting arm relative to said cover member and to one another;

wherein said cover member includes first and second cover members each having an associated lifting assembly with first and second lifting arms;

wherein said cover assembly includes a linkage extending between said second lifting arm of said first cover member and said second lifting arm of said second cover member, said linkage being configured to create a locking and sealing arrangement between said first and said second cover members.

9. A spa, comprising:

a base having a plurality of sidewalls;

a first pivot pin mounted to one of said sidewalls;

a shell supported by said base and configured to hold a volume of liquid;

a cover member selectively movable between a covered position atop said shell and an uncovered position adjacent to another of said sidewalls of said base;

a second pivot pin mounted to said cover member; and a lifting mechanism configured to effect movement of said cover member between said covered position and said uncovered position, said lifting mechanism including a first lifting arm and a second lifting arm, said first lifting arm being pivotally and slidably coupled to said sidewall to which said first pivot pin is mounted at a first end of said first lifting arm and pivotally coupled to said cover member and to said second lifting arm at said second pivot pin, said second pin being directly coupled to a second end of said first lifting arm;

wherein said first lifting arm includes a longitudinal slot in said first end of said first lifting arm, said longitudinal slot receiving said first pivot pin for effecting said pivotal and slidable coupling of said first lifting arm to said sidewall of said base.

10. The spa of claim 9, wherein:

said second lifting arm is pivotally coupled to said cover member.

11. The spa of claim 9, wherein:

said lifting mechanism further includes a handle extending from a distal end of said second lifting arm.

12. The spa of claim 11, wherein:

said cover member has a recess formed in an outer surface of said cover member, said recess being sized and shaped to receive said handle therein.

13. The spa of claim 9, wherein:

said cover member includes a peripheral flange formed on an underside of said cover member, said flange being configured to contact an upper rim of said shell when said cover member is in said covered position.

14. The spa of claim 9, wherein:

said second pivot pin extends though said cover member.

15. The spa of claim 9, wherein:

said first lifting arm includes at least one position stop, said position stop being configured to limit rotation of said second lifting arm relative to said first lifting arm.

16. A method for a spa having a base and a shell supported by said base, said method comprising the steps of:

mounting a first pivot pin to one of a plurality of sidewalls of said base;

providing a first cover member atop said shell;

equipping said cover member with a lifting mechanism, said lifting mechanism including a first lifting arm and a second lifting arm, said first lifting arm being pivotally and slidably coupled to the sidewall of said base to which said first pivot pin is mounted at a first end of said first lifting arm;

wherein said first lifting arm includes a longitudinal slot in said first end of said first lifting arm, said longitudinal slot receiving said first pivot pin for effecting said pivotal and slidable coupling of said first lifting arm to said sidewall of said base;

wherein said first lifting arm and said second lifting arm are connected to a second pivot pin extending from said cover member, said second pivot pin providing for pivoting of both said first lifting arm and said second lifting arm relative to said cover member and to one another;

wherein said lifting mechanism is operable to selectively move said cover member from a covered position in which said cover member rests atop said shell, and an uncovered position in which said cover member is adjacent to another of said sidewalls of said base;

providing a second cover member atop said shell and equipping said second cover member with a respective first and second lifting arm; and extending a tether between said second lifting arm of said second cover member and said second lifting arm of said first cover member, said tether being configured to effect a locking and sealing arrangement between said first and second cover members.

17. The method according to claim 16, further comprising the step of:

coupling a handle to a distal end of each of said second lifting arms.

* * * * *